US005675519A

United States Patent [19]

Yotsuyanagi et al.

[11] Patent Number: 5,675,519

[45] Date of Patent: Oct. 7, 1997

[54] APPARATUS AND METHOD FOR CONTROLLING CENTRIFUGAL SEPARATOR AND CENTRIFUGATION SIMULATION METHOD AND CENTRIFUGAL SEPARATOR

[75] Inventors: Mitsutoshi Yotsuyanagi, Chiba; Kazuyoshi Tokunaga; Masataka Morita, both of Katsuta, all of Japan

[73] Assignee: Hitachi Koki Co., Ltd., Tokyo, Japan

[21] Appl. No.: 296,629

[22] Filed: Aug. 26, 1994

[30] Foreign Application Priority Data

Aug. 27, 1993 [JP] Japan ..... 5-212718
Jul. 20, 1994 [JP] Japan ..... 6-189913

[51] Int. Cl.[6] ..... B04B 9/10

[52] U.S. Cl. ..... 364/578; 494/37

[58] Field of Search ..... 364/578, 188, 364/496, 497, 498, 499; 233/23 R; 494/10, 37

[56] References Cited

U.S. PATENT DOCUMENTS

| | | | |
|---|---|---|---|
| 3,806,718 | 4/1974 | Stewart | 364/498 |
| 3,807,630 | 4/1974 | Stewart | 364/497 |
| 4,244,513 | 1/1981 | Fayer et al. | 494/10 |
| 4,471,447 | 9/1984 | Williams et al. | 364/525 |
| 4,941,868 | 7/1990 | Chulay et al. | 494/37 |
| 5,171,206 | 12/1992 | Marque | 494/37 |
| 5,287,265 | 2/1994 | Hall et al. | 364/188 |
| 5,318,500 | 6/1994 | Kelley et al. | 494/37 |
| 5,370,599 | 12/1994 | Marque et al. | 494/37 |
| 5,428,470 | 6/1995 | Labriola, II | 364/496 |
| 5,552,997 | 9/1996 | Massart | 364/496 |

FOREIGN PATENT DOCUMENTS

| | | | |
|---|---|---|---|
| 0 344 453 | 4/1989 | European Pat. Off. | B04B 13/00 |
| 0344453 | 12/1989 | European Pat. Off. . | |
| 6-79198 | 3/1994 | Japan | B04B 13/00 |
| WO93/15844 | 8/1993 | WIPO | B04B 13/00 |

OTHER PUBLICATIONS

Websters II New Riverside University Dictionary, The riverside Publishing Company, p. 1086 1984.

"Microcomputer in Biology", edited by R. Ireland et al., pp. 241–276.

"Preparative Centrifugation", edited by D. Rickwood, pp. 19–21 and 187–232.

"Centrifugation: Theory and Experiment", pp. 127–140, 260–268, 290–291 and 281–283, B.D. Young.

*Primary Examiner*—Kevin J. Teska
*Assistant Examiner*—Matthew Loppnow
*Attorney, Agent, or Firm*—Lowe, Price, LeBlanc & Becker

[57] ABSTRACT

In an apparatus and a method for controlling centrifugal separator, simulation is performed, in Steps S1 to S4, for the process before and after change of parameters as centrifugation condition. The results are compared in Step S10, and operation of the centrifugal separator is controlled in Step S11. To obtain the measured data of the specimen, an attachment for analysis 15 is used, and the results are compared with the results of simulation, and parameters are corrected. To display the process in the middle of centrifugation, simulation is performed using the current parameters during operation of centrifugation, and the results are shown by graphic display on a display unit 2.

6 Claims, 10 Drawing Sheets

APPARATUS AND METHOD FOR CONTROLLING CENTRIFUGAL SEPARATOR AND CENTRIFUGATION SIMULATION METHOD AND CENTRIFUGAL SEPARATOR

BACKGROUND OF THE INVENTION

1. Field of the Invention

The present invention relates to a centrifugal separator and a method for controlling the same, and in particular to an apparatus and a method for performing simulation of centrifugation.

2. Description of the Prior Art

It is commonly practiced to determine the condition for centrifugation when separating specimens in the technique of centrifugation by adopting the conditions described in the literature for separating similar specimens or by finding out optimal condition on trial and error basis.

Centrifugation method is roughly divided into differential centrifugation, density gradient sedimentation velocity centrifugation, and density gradient sedimentation equilibrium centrifugation. Of these methods, the differential centrifugation is a method to collect the specimens as precipitates, and the density gradient sedimentation equilibrium centrifugation is a method to condense the specimens in a portion having the same density as that of the specimen particles in density gradient. When centrifugation is performed by these methods, the results of separation will not be worsened due to excessive centrifugation time. In contrast, the density gradient sedimentation velocity centrifugation is to separate mixture of diverse specimen particles piled up over density gradient liquid according to the difference of sedimentation velocity between components. If centrifugation time is too long, all of the specimens are precipitated and cannot be separated. Thus, special care should be taken in determining the centrifugation time.

In case the same apparatus as described in the literature is not available or in case a new unknown specimen is to be separated, there has been no other way but to find out optimal condition on trial and error basis by attempting to separate the substances to be separated under various conditions as preliminary experiment. Even when the condition of centrifugation has been determined as the result of such trial and error, the condition of separation had to be changed in case the apparatus used in the past is not available or in case it has been changed to an apparatus with higher efficiency. Thus, a new condition had to be found again by trial and error. For such preliminary experiment based on trial and error, extremely long time is required and high cost is involved such as the use of expensive reagents, and valuable biological specimens are often wasted.

In recent years, attempts have been made on simulation of centrifugation, in which separation conditions of the specimens are estimated from centrifugation condition and the specimen to be separated as well as the properties of solution where the specimens are suspended and are displayed in graphics so that conditions for centrifugation can be determined without performing preliminary experiment on trial and error basis. For example, simulation program for separation method called density gradient sedimentation velocity centrifugation is described in "Microcomputers in Biology" edited by R. Ireland and S. P. Long or "Preparative Centrifugation" edited by D. Rickwood (both published by IRL Press Co.). Also, simulation for separation method called sedimentation equilibrium centrifugation has been filed as patent application by the present applicant and has already been laid open (Japanese Patent Laid-Open Publication Hei 6-79198). With the advent of these simulation functions, it is expected that the frequency of preliminary experiment by trial and error as in the past will be extensively reduced. In these simulation functions, various properties of the specimens to be separated and the solutions are used as calculation parameters.

In the past, in case centrifugation condition has to be changed, there has been a method to change the condition in such a manner that physical factor to indicate centrifugal force of integration, i.e. $\omega\times\omega\times t$ (where $\omega$ represents angular acceleration, and t represents time) becomes identical with the condition before the change. In this method, however, no consideration is given on radius of rotation and sedimentation distance, and only the number of revolutions of rotor, which rotates, and operation time are involved. As a result, considerable difference occurs in the results of separation unless rotors with different radius of rotation or different sedimentation distance is used. Also, another method has been widely used, in which the conditions are changed in such a manner that product of centrifugal force and time becomes identical with the conditions before the change. In this method, no consideration is given on sedimentation distance of the specimen, and difference occurs in the results of separation when the rotor is changed as in the method described above. As an alternative method, there is a method to use K factor,which is a factor to indicate ability of the rotor. K factor is widely used in the field of centrifugation, and the details are described in a number of literatures including "Preparative Centrifugation" as mentioned above. K factor is a value obtained by Formula 1. Because it is calculated from maximum radius of rotation and minimum radius of rotation of the solution with the specimen suspended therein in the rotor, and from number of revolutions of the rotor, no error occurs due to rotor size unlike the results of the above two methods.

$$K=\frac{\ln(R\max)-\ln(R\min)}{\omega\times\omega}\times\frac{10^{13}}{3600} \qquad \text{(Formula 1)}$$

Rmax: Maximum radius of rotation of specimen suspension solution

Rmin: Minimum radius of rotation of specimen suspension solution $\omega$: Angular acceleration of rotor In order to inform the results of the simulation of centrifugation to a user at a glance, there is a display unit for graphic display, and this convenience is provided by displaying the results of simulation together with parameters such as operating condition.

Practical meaning of K factor as described above is that the time of sedimentation of specimen particles from liquid surface of the suspension liquid to the bottom of centrifugation tube. For this reason, accurate values can be calculated by the differential centrifugation, in which the specimen is precipitated down to the bottom of the centrifugation tube, while error increases when the density gradient sedimentation velocity centrifugation is used, in which a separation layer is formed in the middle of the centrifugation tube.

In some of the conventional type centrifugal separators, the value $\omega\times\omega\times t$ is set, and operation is stopped as soon as the preset value of $\omega\times\omega\times t$ has been reached. Besides this, no operation control mechanism useful for the change of centrifugation condition is available.

SUMMARY OF THE INVENTION

Therefore, it is first object of the present invention, when centrifugation conditions such as rotor or number of revolutions of the rotor are changed in the density gradient sedimentation velocity centrifugation, which is one of the density gradient centrifugation methods, to provide an apparatus for controlling centrifugal separator, by which it is possible to calculate centrifugation condition to obtain the same separation results as before the change and operation can be stopped as soon as this condition has been reached.

Physical properties of a solution are univocally determined when the solution is determined, but the properties of the specimen change according to the environmental conditions such as concentration of suspension solution of the specimen itself, and it is impossible to provide all calculation parameters in advance in each case. As a result, execution of simulation using accurate parameters is limited to several typical cases, and there is no other alternative but to adopt a representative value, which is expected to be relatively closer to a calculation parameter. Thus, only approximation simulation can be performed. Moreover, in simulation of separation of unknown specimen, whose properties are not identified, it is often indefinite whether the selected representative value is appropriate or not, and only simulation with lower accuracy can be achieved.

Therefore, it is second object of the present invention to provide a method for simulating centrifugation, by which it is possible to simulate centrifugation at high accuracy by a combination of the same solution and specimen as actual separation using actual measured data of the specimen.

In the conventional type centrifugation separator, centrifugation condition is preset and operation is performed for a predetermined period of time, while it is impossible to know the condition in the process, and the condition of centrifugation can be identified only after the preset time determined in the operating condition has elapsed. Although certain types of centrifugal separator are available, by which intermediate condition can be monitored, as an ultracentrifugation separator for analysis, such separators are not suitable for collection of samples and do not suit the intended purpose.

Simulation program for centrifugation has also been developed, while it is not always used in perfect combination with centrifugal separator, and it is not possible to accurately identify the condition at the moment. In case centrifugation is performed up to the last moment under the initially preset condition, it is possible to execute simulation program in advance and to estimate the condition in the middle of the process from the results. However, in case operating condition is changed in the middle of the process, it is impossible to know the condition of separation as desired.

Therefore, it is a third object of the present invention to provide a centrifugal separator, by which it is possible to display intermediate process of centrifugation on a display unit.

To attain the first object of the present invention, in finding position of a separation layer of a specimen to be detected by simulation, simulation is performed using centrifugation condition established as centrifugation method of a specimen as parameters, and simulation is performed under centrifugation condition used for centrifuging said specimen by means of a centrifugation separator, and operation of the centrifugal separator is controlled by comparing the results of each of the simulations.

According to the present invention, there is provided an apparatus for controlling a centrifugal separator, comprising:

means for inputting centrifugation condition already established as a centrifugation method for a specimen, which is to be centrifuged by a centrifugal separator, as first parameters;

means for inputting centrifugation condition to be used when said specimen is actually centrifuged by said centrifugal separator as second parameters;

means for executing simulation of centrifugal condition using said first parameters and said second parameters respectively;

means for comparing the result of said simulation obtained by the use of said first parameters and said second parameters to determine whether or not these two results have become identical with each other, or to calculate operating time when these two results will be identical with each other; and means for generating a signal for controlling operation of said centrifugal separator in accordance with said means for determining or calculating.

Further, according to the present invention there is provided a method for controlling a centrifugal separator, comprising the steps of:

inputting centrifugation condition already established as centrifugation method of said specimen, when centrifuging a specimen by a centrifugal separator, before starting centrifugation or during centrifugation as first parameters;

executing simulation of centrifugation condition using said first parameters;

inputting centrifugation condition to be used when said specimen is centrifuged by said centrifugal separator as second parameters;

executing simulation of centrifugal separation using said second parameters;

comparing the results of said simulation obtained by the use of said first parameters and said second parameters to determine whether or not these two results have become identical with each other or to calculate operating time when these two results will be identical with each other; and generating a signal for controlling operation of said centrifugal separator in accordance with the determining step or calculating step.

Next, to attain the above second object in the present invention, an attachment for analysis and a rotor for analysis are mounted on a centrifugal separation, on which the attachment for analysis can be mounted, a specimen is placed on a rotor for analysis to operate the centrifugal separator and simulate centrifugation, the specimen is optically analyzed using the attachment for analysis, and parameters used for simulation are corrected by the use of the data thus obtained.

Therefore, according to the present invention there is provided a method for simulating centrifugation, comprising the steps of:

mounting an attachment for analysis and a rotor for analysis on a centrifugal separator, on which the attachment for analysis can be mounted, and placing a specimen on said rotor for analysis;

starting operation of said centrifugal separator;

simulating centrifugation according to predetermined centrifugation condition and other information;

optically analyzing said specimen using said attachment for analysis; and correcting parameters to be used for said simulation by the use of data obtained as the result of said analysis.

Further, in order to attain the above third object of the present invention, in a centrifugal separator provided with a function to simulate centrifugation and with a display unit for displaying the result of simulation, and a parameter for centrifugation operation is incorporated as a part of the parameters for simulation during centrifugation of the centrifugal separator.

Therefore, according to the present invention there is provided a centrifugal separator, provided with a function to simulate centrifugation and with a display unit for displaying results of said centrifugation simulation, characterized by:

means for incorporating parameters for centrifugation operation as a part of parameters for said centrifugation simulation during centrifugation operation of said centrifugal separator.

With the arrangement as described above, it is possible according to an apparatus for controlling centrifugal separator of Claim 1 and to a method for controlling centrifugal separator of Claim 4 to obtain the separation results identical with those before changing of the condition and to extensively save cost and expense required for preliminary evaluation.

It is possible according to a method for centrifugation simulation of Claim 5 to simulate centrifugation under a condition very closer to actual separating operation because the information obtained by the attachment for analysis is added. Thus, the user can evaluate various experimental condition without performing preliminary experiment on trial and error basis to determine experimental condition.

Further, it is possible according to a centrifugal separator of the invention to identify the current centrifugation condition via graphic display and numerical display. Accordingly, it is possible to detect that a certain degree of centrifugation condition has been obtained by the result of centrifugation simulation and to change subsequent separating condition to a more favorable condition at that very moment.

BRIEF DESCRIPTION OF THE DRAWINGS

Other features and objects and advantages of the present invention will become apparent from the following description of preferred embodiments with reference to the drawings in which like reference characters and symbols designate like or corresponding parts or elements throughout the drawings, in which.

DETAILED DESCRIPTION OF THE PREFERRED EMBODIMENTS

In the following, description will be given on the preferred embodiments of the present invention in connection with the drawings. Because the present invention relates to an apparatus and a method for controlling a centrifugal separator and to a method for simulating centrifugation and a centrifugal separator, description on the embodiments will also be given in this order.

Figure 1:
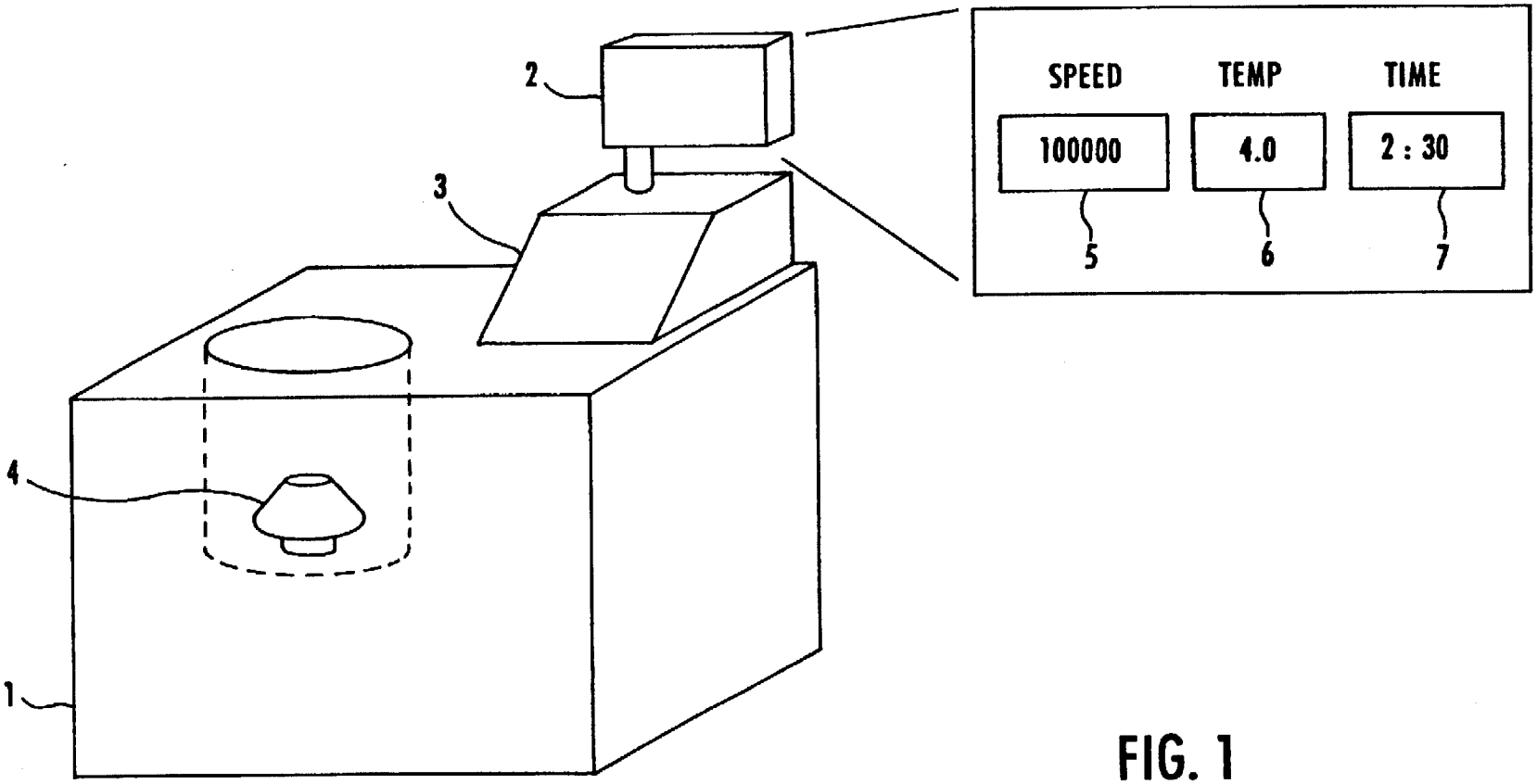
FIG. 1 is a perspective view of a centrifugal separator for explaining preferred embodiments of an apparatus and a method for controlling centrifugal separator of the present invention.

[1] Embodiment of an apparatus and a method for controlling a centrifugal separator FIG. 1 is a perspective view of a centrifugal separator for explaining preferred embodiments of an apparatus and a method for controlling centrifugal separator of the present invention. In FIG. 1, a main unit 1 of the centrifugal separator comprises a display unit 2 for displaying operation parameters and a manipulation panel for inputting parameters for centrifugation. In general, the specimen to be separated is placed into a test tube called a centrifugation tube and is then arranged in a rotor 4, which is disposed in the centrifugal separator 1, and centrifugation is performed by rotating the rotor 4 by a motor (not shown). In general, centrifugation parameters preset by the user and/or parameters for the current operating conditions are displayed on the display unit 2.

These parameters include number of revolutions 5, temperature 6, operating time 7, etc., and these are displayed on a part of the display unit 2 respectively. Because of the character of the present invention, type and dimension of the rotor 4 to be used for separation are included in the centrifugation parameters.

Figure 2:
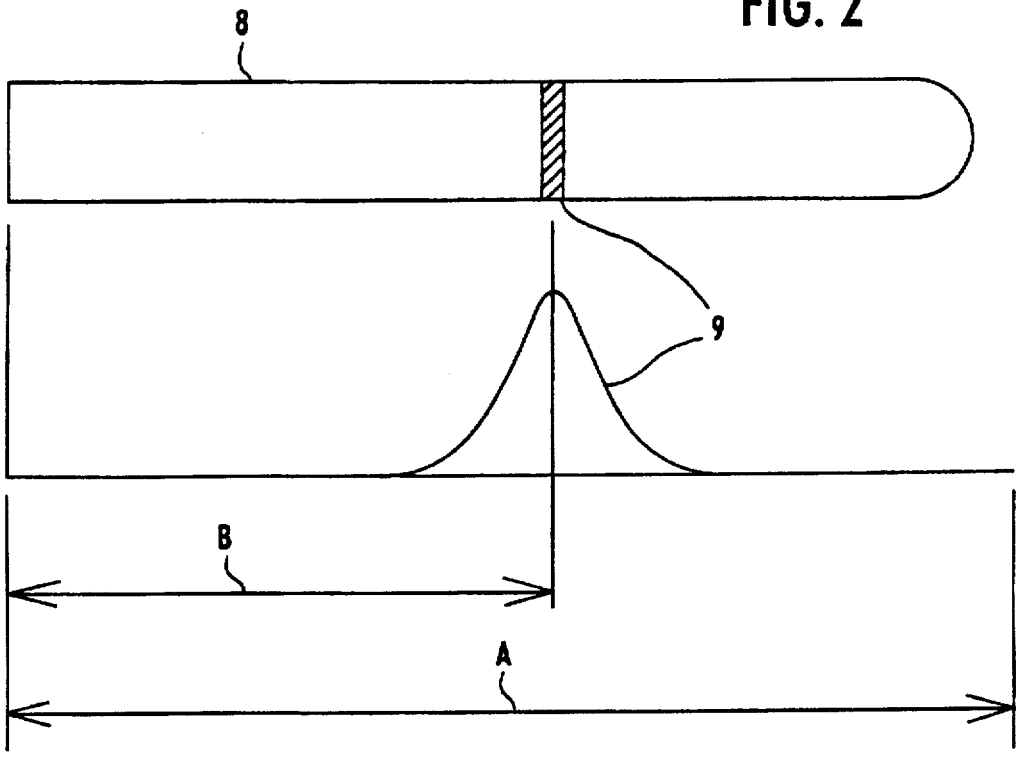
FIG. 2 is a schematical drawing of an example of results of simulation using parameters before change.

In the present invention, centrifugation parameters of centrifugation method already established are used as centrifugation parameters before change and are inputted by the manipulation panel 3, and simulation is performed by simulation function incorporated in the main unit 1 of the centrifugal separator. FIG. 2 shows an example of the result of simulation before change. As the result of the simulation, the position of a separation layer 6 of the specimen formed in the centrifugation tube filled with solution can be obtained. In this case, total sedimentation distance A, i.e. distance from liquid surface (left in the figure) to bottom of the centrifugation tube, and specimen sedimentation distance B, i.e. distance from liquid surface to the specimen separation layer 9, are obtained.

Figure 3:
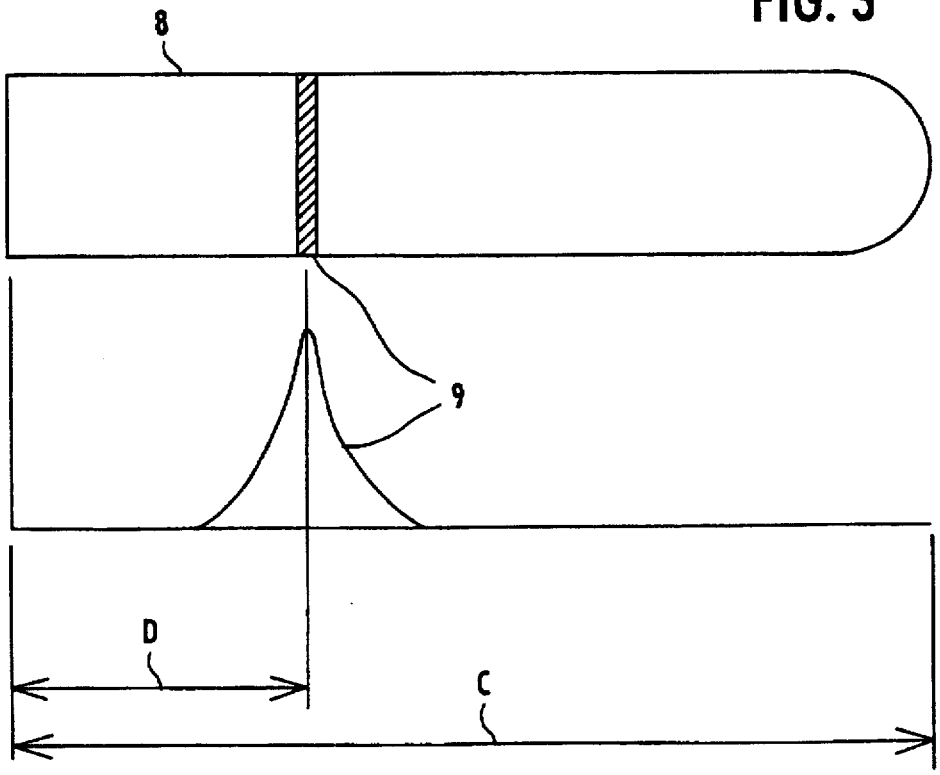
FIG. 3 is a schematical drawing of an example of results of simulation using parameters after change.

Next, the centrifugation parameters after change are inputted by means of the manipulation panel 2, and operation of the centrifugal separator 1 is started. At an adequate time interval during the operation, said simulation program is executed using the current operation parameters. As an example, in case operating time is from several hours to 10 and several hours, a practical result has been obtained by simulation at 10-minute interval. FIG. 3 shows an example of such simulation. In this case, the total sedimentation distance C is constant throughout the operation, while the specimen sedimentation distance D increases or decreases according to the course of operating time because the specimen separation layer 9 migrates toward a certain direction as the operating time elapses. For each simulation, the total sedimentation distance D and the specimen sedimentation distance C are obtained.

Each time simulation after change is performed, it is determined from A, B, C and D whether or not the current separation condition is identical with the result of separation before the change or not. As the methods to determine whether or not identical separation has been performed, there are the following methods (1) to (3):

(1) It is determined that identical separation has been performed when specimen sedimentation distances are identical with each other, i.e. when B=D.

(2) It is determined that identical separation has been performed when the distance from bottom of the centrifugation tube to the specimen separation layer 9 has become identical, i.e. when A−B=C−D.

(3) It is determined that identical separation has been obtained when the ratio of position of the separation layer to length of a portion filled with solution of the centrifugation tube is identical with each other, i.e. when B/A=C/D.

An adequate method is selected from the above methods (1) to (3) according to difference of rotor size or to properties of the specimen to be separated. For example, in case a rotor is used, which has the sedimentation distance relatively closer to that of the rotor used for centrifugation condition before change, the methods (1) or (2) are used, and in case a rotor is used, which has extremely different sedimentation distance, the method (3) is adopted. As the result of the determination, if it is determined that separation identical with the result of separation before change is being obtained now, or identical separation result will be obtained up to the time of the next simulation, operation of the centrifugal separator main unit 1 is stopped.

As other embodiments, there is a method, in which simulation function is executed in advance before operating time is inputted to the centrifugal separator 1, and operating time for executing the simulation function is sequentially changed, and after operating time to obtain separation result identical with that of before the change of centrifugation condition has been determined, operating time obtained as operating condition of the centrifugal separator 1 is adopted.

Figure 4:
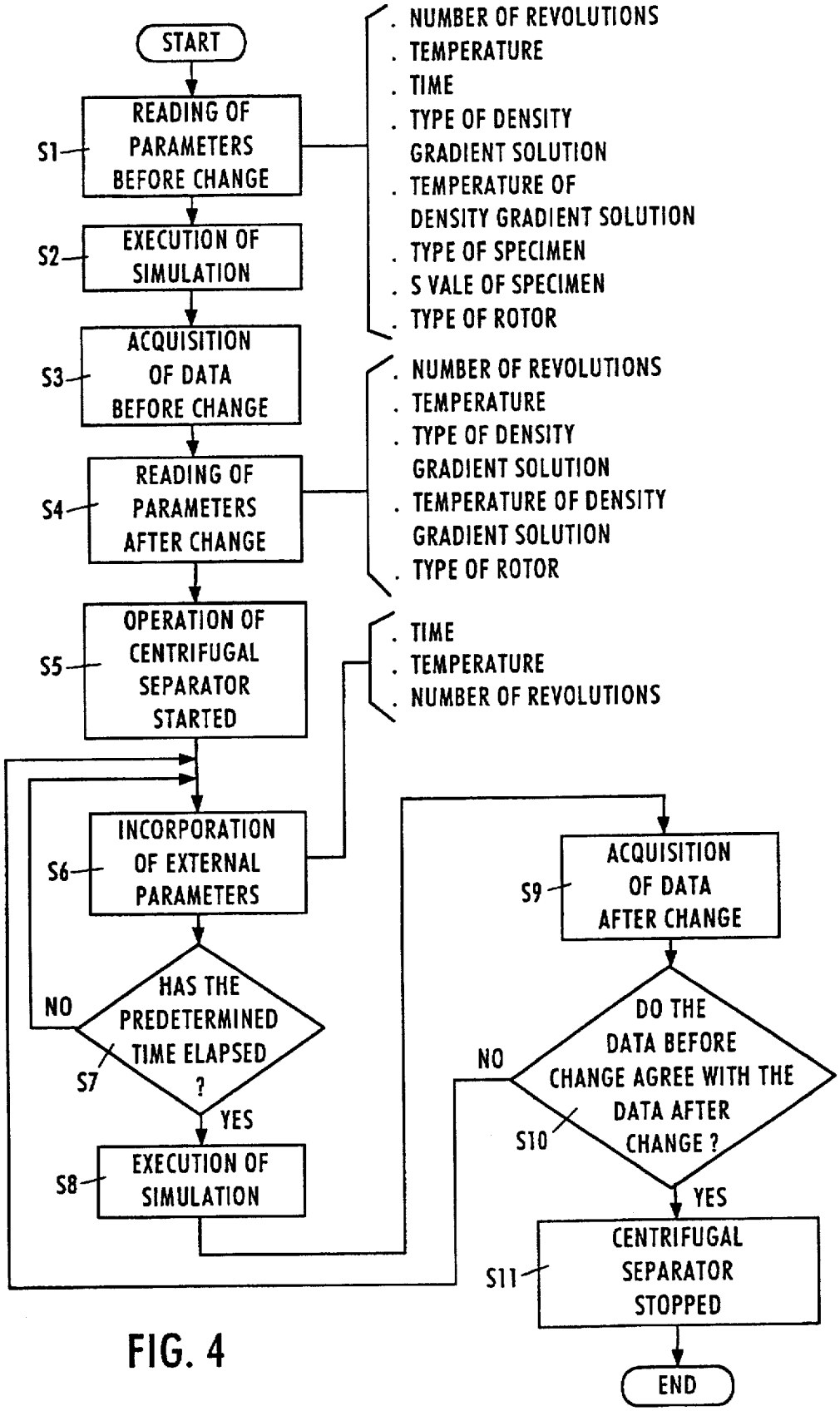
FIG. 4 is a flowchart showing an example of control procedure of the present invention.

FIG. 4 is a flowchart, showing flow of control to stop operation in the preceding case, i.e. in case simulation results are identical with each other. In the flow of FIG. 4, parameters (such as number of revolutions, time, type of specimen, etc.) before change are read in Step S1. That is, these parameters are already inputted in advance via the manipulation panel 3. In Step S2, the predetermined simulation is executed, and the result is obtained in Step S3 as data and is stored in memory. In Step S4, parameters after change are read and operation of the centrifugal separator is started in Step S5. In Step S6, external parameters are incorporated, and it is determined in the next Step S7 that a predetermined time has elapsed.

Until a predetermined time has elapsed, Steps S6 and S7 are repeatedly executed. After the predetermined time has elapsed, simulation is performed using parameters after change in Step S8, and the result is stored in memory as data in Step S9. In Step S10, the data obtained in Steps S3 and S9 and stored in memory are compared with each other, and it is determined whether or not the data agree with each other. As such data, the one expressing the position of the specimen separation layer can be used. If the data do not agree with each other, the procedures in Steps S6 to S10 are repeated. If agreed, control signal to stop operation of the centrifugal separator is prepared in Step S11, and the centrifugal separator is stopped.

Figure 5:
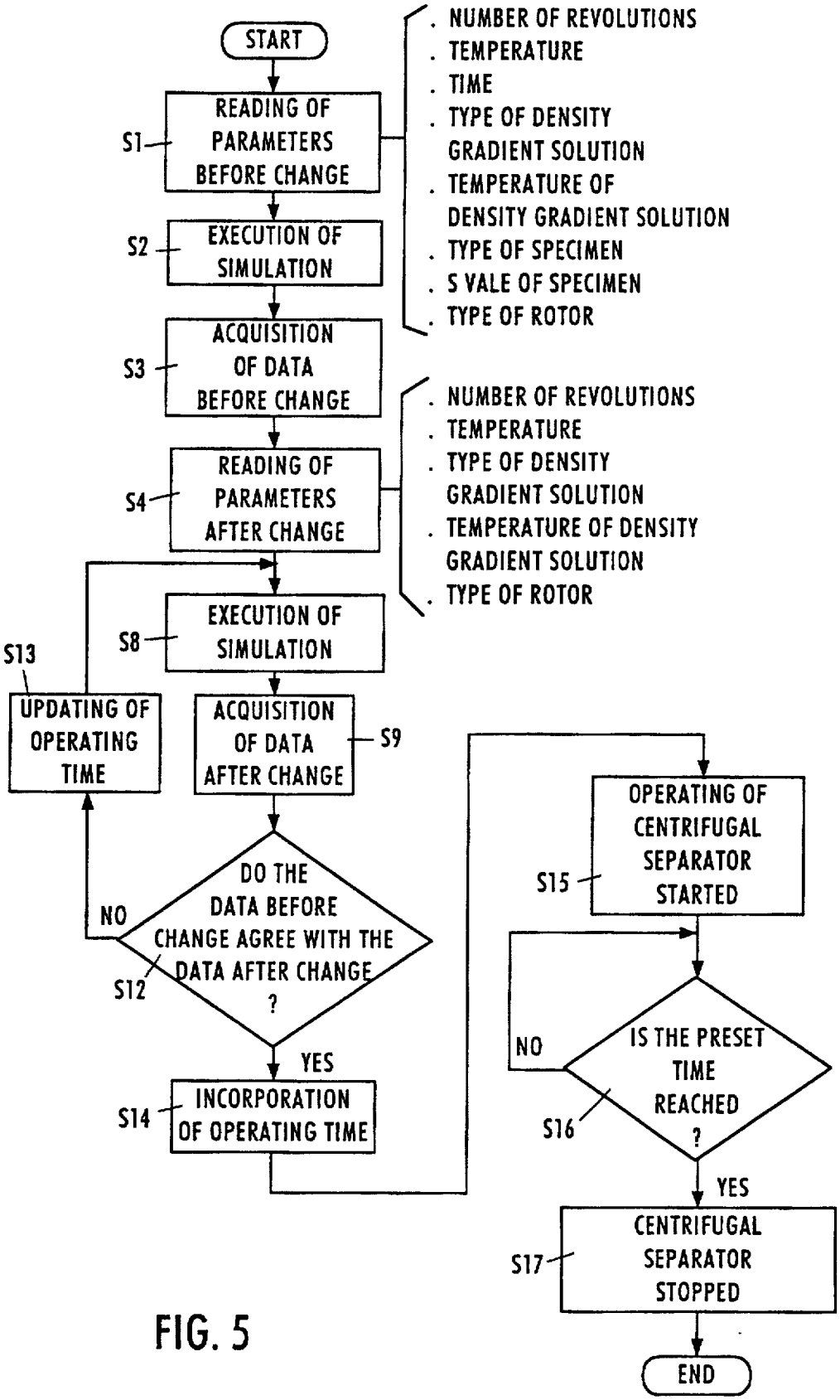
FIG. 5 is a flowchart showing another example of control procedure of the present invention.

Next, as shown in FIG. 5, simulation is performed using parameters before change and after change, as given in other examples in the above, and operating time of the centrifugal separator when the results of the simulation will be identical with each other is calculated.

Steps S1 to S4 are the same as in FIG. 4, and detailed description is not given here. Steps S8 and S9, which follow Step S4, are also substantially the same as in FIG. 4, and simulation is performed using parameters after change. However, it is different from FIG. 4 in that operation of the centrifugal separator is not started at this time point. In Step S12, it is determined whether the data before and after the change agree with each other or not. If they do not agree with each other, operating time is updated in Step S13, and simulation of Step S8 is performed. If agreed, operating time preset in Step S14 is incorporated in memory, and operation of the centrifugal separator is started in Step S15. In the next Step S16, it is determined whether or not operating time of centrifugal separator has reached the preset operating time stored in memory in Step S14 or not. If it has reached, control signal to stop the centrifugal separator is prepared in Step S17, and the centrifugal separator is stopped.

The flows shown in FIGS. 4 and 5 are executed by a microcomputer comprising CPU, memory, interface, etc. (not shown), which are main components of the apparatus for controlling centrifugal separator of the present invention. General control of the centrifugal separator utilizing microcomputer is already known, and detailed description on hardware is not given here. The apparatus for controlling centrifugal separator of the present invention, which executes the flows of FIGS. 4 and 5 for simulation, can be provided inside the centrifugal separator main unit 1, or a personal computer for simulation and control may be installed outside and this may be connected with the centrifugal separator main unit 1 and cable.

[2] Embodiments of a method for simulating centrifugation

Figure 6:
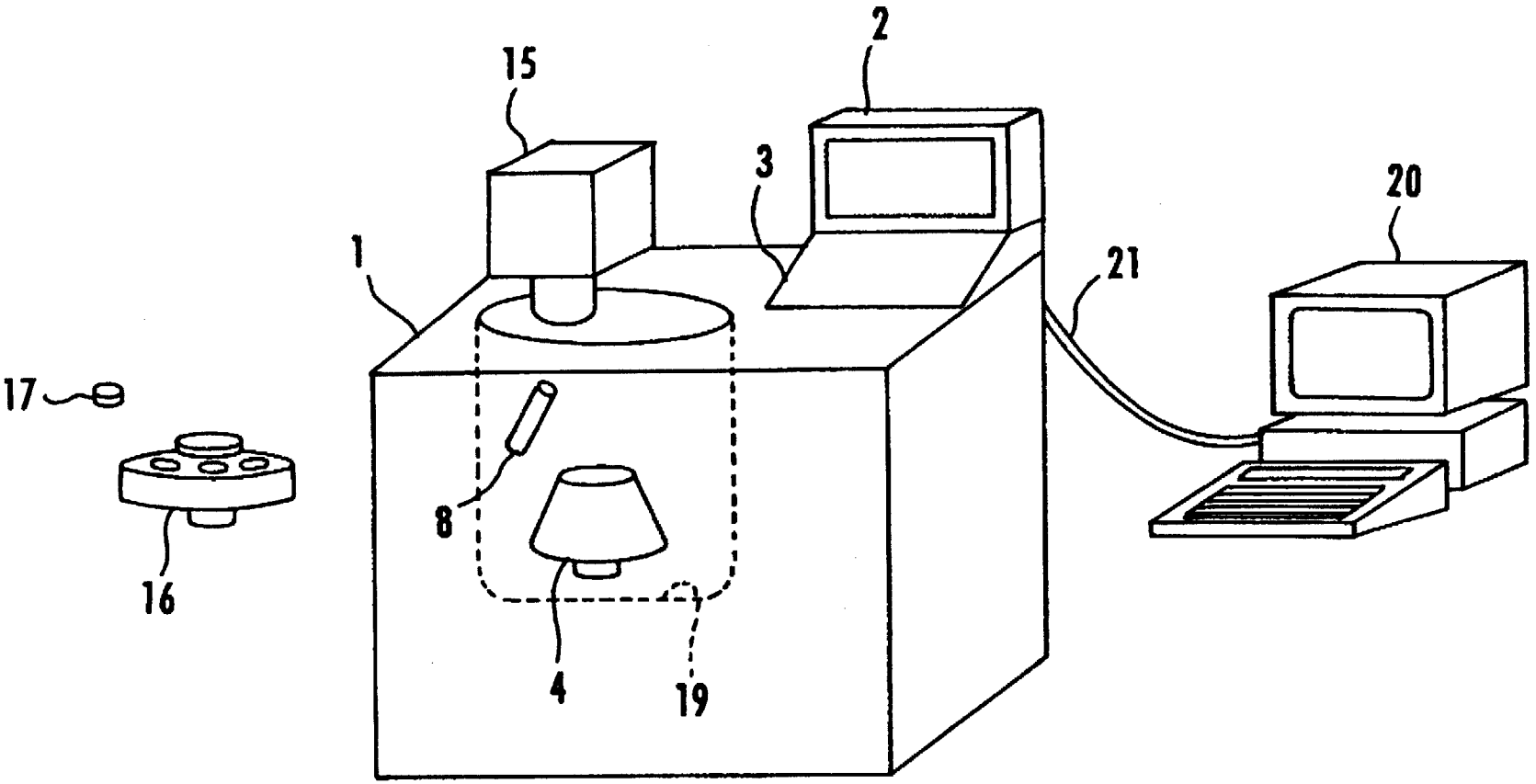
FIG. 6 is a perspective view of a centrifugal separator provided with an attachment for analysis and used to carry out centrifugation simulation method of the present invention.

Next, description will be given on the preferred embodiments of a method for simulating centrifugation of the present invention, referring to FIGS. 6 to 10. FIG. 6 is a perspective view similar to FIG. 1 and shows an arrangement for executing the method for simulating centrifugation of the present invention. The centrifugal separator main unit 1 comprises a display unit 2 similar to that of FIG. 1 and a manipulation panel 3 for inputting centrifugation parameters. In general, the specimen to be separated is placed into a test tube called centrifugation tube 18 and is then arranged in a rotor 4, which is disposed in a rotor chamber 19 of the centrifugal separator main unit 1, and the specimen is separated by rotating the rotor. In general, centrifugation parameters preset by the user and/or parameters for the current operating condition are displayed on the display unit 2. These parameters include number of revolutions, temperature, operating time, etc. and are displayed on a part of the display unit 2 respectively. Because of the character of the present invention, type and dimension of the rotor 4 to be used for separation are included in the centrifugation parameters in this case.

Figure 7:
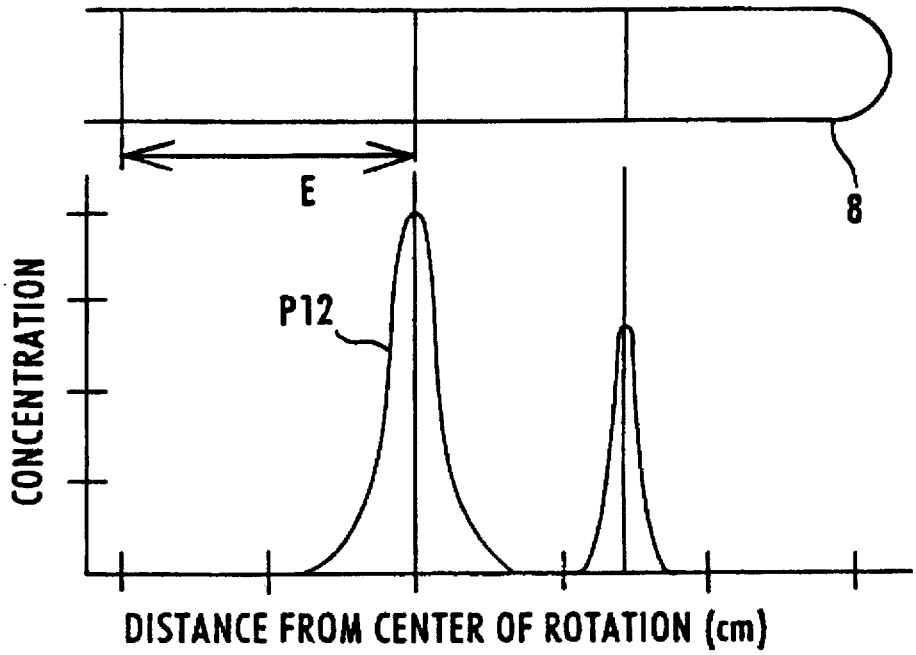
FIG. 7 is a diagram showing results of sedimentation velocity centrifugation simulation as an example of centrifugation simulation method of the present invention.
Figure 8:
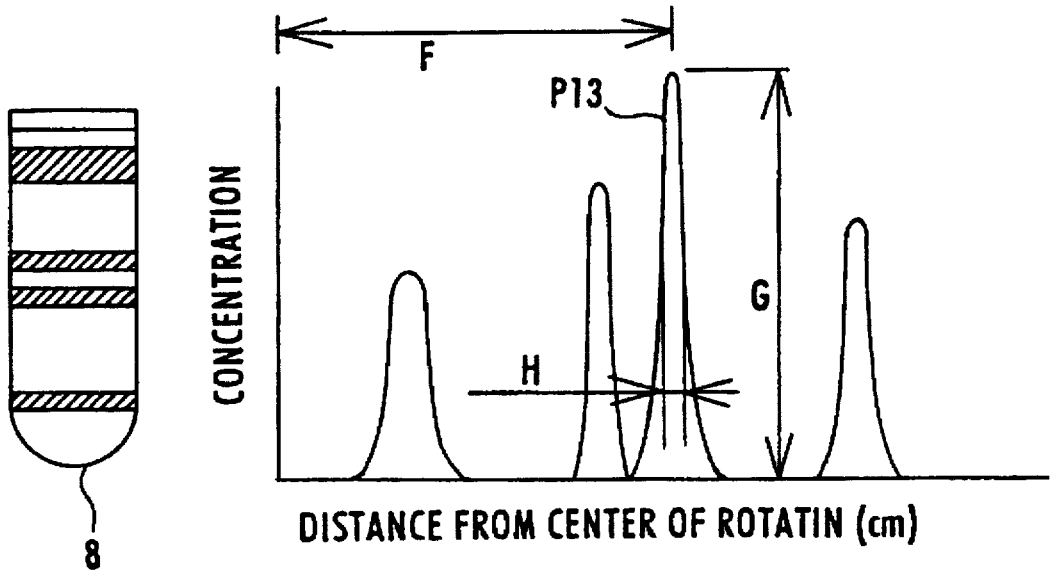
FIG. 8 is a diagram showing results of sedimentation equilibrium centrifugation simulation as an example of centrifugation simulation method of the present invention.

The function to simulate centrifugation is provided in the centrifugal separator main unit 1 or in an external simulation system 20 such as personal computer for executing simulation program. When the function to simulate centrifugation is executed, the results of execution are displayed on the display unit 2 or on display of the external simulation system 20. FIGS. 7 and 8 show examples of display of execution results. Because of the character of the present invention, external simulation system 20 such as personal computer and the centrifugation separator main unit 1 are connected to a communication cable21, and data communication can be achieved between these units. However, in case simulation function is provided in the main unit of the centrifugal separator 1 and the simulation results can be displayed by means of the display unit 2, there is no need to provide the external simulation system 20 and the communication cable 21.

An attachment for analysis 15 can be mounted on the centrifugal separator main unit 1. When the specimen is analyzed using the attachment for analysis 15, not the rotor4 provided with the centrifugation tube 8, but the rotor for analysis 16 with an exclusive cell 17 is used. When the properties of the specimen are analyzed, the solution and the specimen are placed into the cell 17, and the rotor for analysis 16 is rotated by driving the centrifugal separator. By centrifugal force generated, the condition of the specimen, which goes down in the cell 17, are optically measured using a light source arranged in the attachment for analysis 15 or in the rotor chamber 19. Various properties of the specimen are calculated from physical relationship between the solution and the fine particles in the field of centrifugal force. As the methods used for analysis, there are sedimentation velocity centrifugation and sedimentation equilibrium centrifugation. In order to avoid the confusion between sedimentation velocity centrifugation or sedimentation equilibrium centrifugation in analysis method and sedimentation velocity centrifugation or sedimentation equilibrium centrifugation as centrifugation for simulation,those in analysis method is simply called sedimentation velocity centrifugation and sedimentation equilibrium centrifugation, and those of simulation are called sedimentation velocity centrifugation simulation and sedimentation equilibrium centrifugation simulation.

As an example, description will be given on correction of sedimentation velocity centrifugation. To perform sedimentation velocity centrifugation simulation, sedimentation coefficient of specimen particles (S value), solvent used and range of density gradient, rotor size, and operating conditions (number of revolutions, time and temperature) are required. Of these, there is no need to correct the range of density gradient of solvent, rotor size and operating conditions because these are not changed according to specimen or solvent. In contrast, S value depends not only on characteristics of specimen particles but also on the solvent used and its temperature, or concentration of specimen particles. Thus, it is desirable to correct according to the condition in order to perform sedimentation velocity centrifugation simulation at high accuracy. In the analysis of specimen by sedimentation velocity centrifugation, it is possible to determine the velocity of the specimen particles going down in the solution by centrifugal force, i.e. sedimentation velocity. From this sedimentation velocity, it is possible to calculate sedimentation coefficient S, by the following formula, which is described, for example, in "The Ultracentrifuge" published by Svedberg and Pederson in 1940 (Clarendon Press) and is widely known.

$$s = \frac{1}{r\omega^2} \cdot \frac{dr}{dt} \qquad \text{(Formula 2)}$$

r: position of specimen particle (radius of rotation)

ω: Angular acceleration generated by rotation dr/dt: Variation of position r of specimen particle with respect to variation of time t, i.e. sedimentation velocity of specimen particle To express sedimentation coefficient of a biological specimen, this sedimentation coefficient S assumes a very small value, and therefore, generally this value is multiplied by 10 to be used. To express this value, the unit S is used, and this value is generally called S value. As it is evident from the formula1, S value is directly related to sedimentation velocity of the specimen particles. If S value is inaccurate, the position E of peak P12 of the specimen in FIG. 7 is given at a position different from an actual one. That is, in order to perform sedimentation velocity centrifugation simulation at high accuracy, it is very important to determine S value to be used for calculation of simulation. In this case, it is necessary to perform simulation using S value obtained by actual separation condition. In some cases, the properties of the specimen to be separated are already widely known, and its S value is described in literature. However, S value written in the literature is usually standardized, i.e. it is the value in case water is used as the solvent to suspend the specimen particles and the solution infinitely diluted at the temperature of 20° C. The actual separation, however, is very rarely performed under such condition, and S value described in the books should not be used in order to perform sedimentation centrifugation simulation at high accuracy. That is, irrespective of whether the properties of the specimen to be separated are already known or not, it is necessary to re-determine S value of the specimen under the same environment as actual separation in order to perform sedimentation velocity centrifugation simulation at high accuracy. As already described, S value changes according to type of solution, in which the specimen particles are suspended, concentration and temperature of the solution, and concentration of the specimen particles. Of these, the change due to the solution means the change of viscosity and density of the solution due to concentration and temperature of the solution, and it is possible to calculate it by the following physical formula, which is described in the books such as "Centrifugation: Theory and Experiment" edited by D. Rickwood (Hirokawa Shoten).

$$S_{20,W} = S_{T,M}\left(\frac{\eta_{T,M}}{\eta_{20,W}}\right) \cdot \frac{(1-\bar{v}_{20,W}\cdot\rho_{20,W})}{(1-\bar{v}_{T,M}\cdot\rho_{T,M})} \qquad \text{(Formula 3)}$$

$S_{20,w}$: S value in water at 20° C.

$\eta_{20,w}$: Viscosity of water at 20° C.

$\bar{v}_{20,W}$: Partial specific volume of specimen particle in water at 20° C.

$\bar{v}_{T,M}$: Partial specific volume of specimen particle in solvent M at T °C.

$\rho_{20,w}$: Density of water at 20° C.

$S_{T,M}$: S value in solvent M at T °C.

$\eta_{T,M}$: Viscosity of solvent M at T °C.

$\rho_{T,M}$: Density of solvent M at T °C.

However, the relationship between concentration and S value of the specimen particles differs according to the type of specimen particles, and there is no definite relation formula, and the determination of S value using the same concentration as that of actual separation is very effective means to perform sedimentation velocity centrifugation simulation at high accuracy. As the actual means, S value determined by the sedimentation velocity centrifugation using the attachment for analysis 15 at the same concentration of the specimen particles as actual separation is stored in centrifugation simulation function. For this purpose, it is necessary to retain data inside or outside the centrifugation simulation function and to provide a function, by which it is possible to refer to such data when necessary. If the data retaining capacity of this data retaining function is made sufficiently large, it is possible to retain the data of the specimen particles under analysis in sedimentation state using the attachment for analysis 15. If necessary, it is possible to compare and check that the case of sedimentation velocity centrifugation simulation using rotor size of the rotor for analysis 16 and centrifugation condition used for analysis is identical with the actual sedimentation state of the specimen, and also to correct S value in such manner that they become identical with each other. By performing sedimentation velocity centrifugation simulation using the corrected S value, the accuracy of simulation is increased, and it is possible to evaluate specimen under various separation conditions without performing preliminary experiments on trial and error basis as needed in the past.

As another example, description will be given now on correction of sedimentation equilibrium centrifugation simulation. To perform sedimentation equilibrium centrifugation simulation, molecular weight and suspension density of specimen particles, solvent used and its initial concentration, rotor size, and operating conditions (number of revolutions, time and temperature) are required. Of these, the solvent to be used and its initial concentration, rotor size, and operating conditions are not changed according to specimen or solvent, and there is no need to correct them. In contrast, the molecular weight of the specimen particle must be newly determined in case the specimen to be separated is a new unknown specimen. Because suspension density changes according to the solvent to be used, it is desirable to perform correction according to the conditions in order to ensure sedimentation equilibrium centrifugation simulation at high accuracy. In the analysis of the specimen by sedimentation equilibrium centrifugation, it is possible to create density gradient in equilibrium state of the solution, i.e. in a state where sedimentation of solute and diffusion keep balance, and also to obtain molecular weight from the density gradient. For example, it is possible to calculate from the following physical formula, which is described in "Centrifugation: Theory and Experiment" as mentioned above.

$$\frac{d\ln c}{dr^2} = \frac{M \cdot (1 - \bar{\upsilon}\rho) \cdot \omega^2}{2RT} \quad \text{(Formula 4)}$$

r: Radius of rotation

M: Molecular weight of specimen

ρ: Density of solvent

R: Gas constant c: Concentration of specimen at radius r $\bar{v}$: Partial specific volume of specimen ω: Angular acceleration generated by rotation T: Absolute temperature Also, in the analysis by sedimentation equilibrium centrifugation in self-forming density gradient such as cesium chloride, both specimen particles and marker particles are analyzed, and buoyant density of the specimen particles can be calculated from peak positions of the marker particles and specimen particles. In this case, if the solution actually used for separation is used as the self-forming density gradient solution, buoyant density in the solution can be calculated. For example, in "Centrifugation: Theory and Experiment" described above, buoyant density of the specimen particles is calculated by the following formula:

$$\rho = \rho^{\square} + \frac{\omega^2 \cdot \bar{r}}{\beta} \cdot (r - r^{\square}) \quad \text{(Formula 5)}$$

ρ: Buoyant density of marker particle

ω: Angular velocity generated by rotation

β: βcoefficient of solution r : Position of peak of specimen particle $r^{\square}$: Position of peak of marker particle $\bar{r}$: $(r+r^{\square})/2$ The separation of the specimen by sedimentation equilibrium centrifugation is performed by utilizing buoyant density of the specimen. Also, molecular weight exerts influence on shape of the peak of the specimen particles in sedimentation equilibrium centrifugation simulation. If these values are not accurate, the position F of the peak 13 of the specimen in FIG. 8 is given at a position different from the result of actual separation, and the height G and the width H of the peak of the specimen are considerably deviated from the results of actual separation,and centrifugation time cannot be determined. That is, in order to perform sedimentation equilibrium centrifugation simulation with high accuracy, the determination of molecular weight and buoyant density of the specimen plays an important role in the case of S value in sedimentation velocity centrifugation simulation. Specifically, in order to increase the accuracy of sedimentation equilibrium centrifugation simulation, it is necessary to perform simulation with molecular weight and buoyant density under the environmental conditions, to which the specimen is subject. The value of buoyant density is known in many cases of standard specimens in typical solution, while, if composition of base or 3-dimensional structure are different even if DNA is the same, buoyant density varies, and it is necessary to determine buoyant density under the environmental condition where separation is performed. Molecular weight does not change according to environmental condition, but it is not known when a new unknown specimen is to be separated, and it must be newly determined. As in the case of sedimentation velocity centrifugation simulation, the values of molecular weight and buoyant density determined by sedimentation equilibrium centrifugation using the attachment for analysis under the same condition as actual separation (not required when molecular weight is determined) are stored in centrifugation simulation function. In this case, similarly to the case of sedimentation velocity centrifugation simulation, it is necessary to retain the data inside or outside centrifugation simulation function, and to provide the function to refer to such data when necessary. If data retaining capacity of this data retaining function is made sufficiently large, it is possible to retain the data of sedimentation state of the specimen particles under analysis. Thus, it is possible to compare and check that the case where sedimentation equilibrium centrifugation simulation is performed using the determined values and rotor size of the rotor for analysis 16 is identical with the actual sedimentation condition of the specimen and to correct buoyant density and molecular weight in such manner that they become identical with each other.

By performing sedimentation equilibrium centrifugation simulation using the values of molecular weight and buoyant density thus corrected, accuracy of simulation is increased, and it is possible to evaluate specimen separation under various separating conditions without performing preliminary experiments on trial and error basis as necessary in the past.

Figure 9:
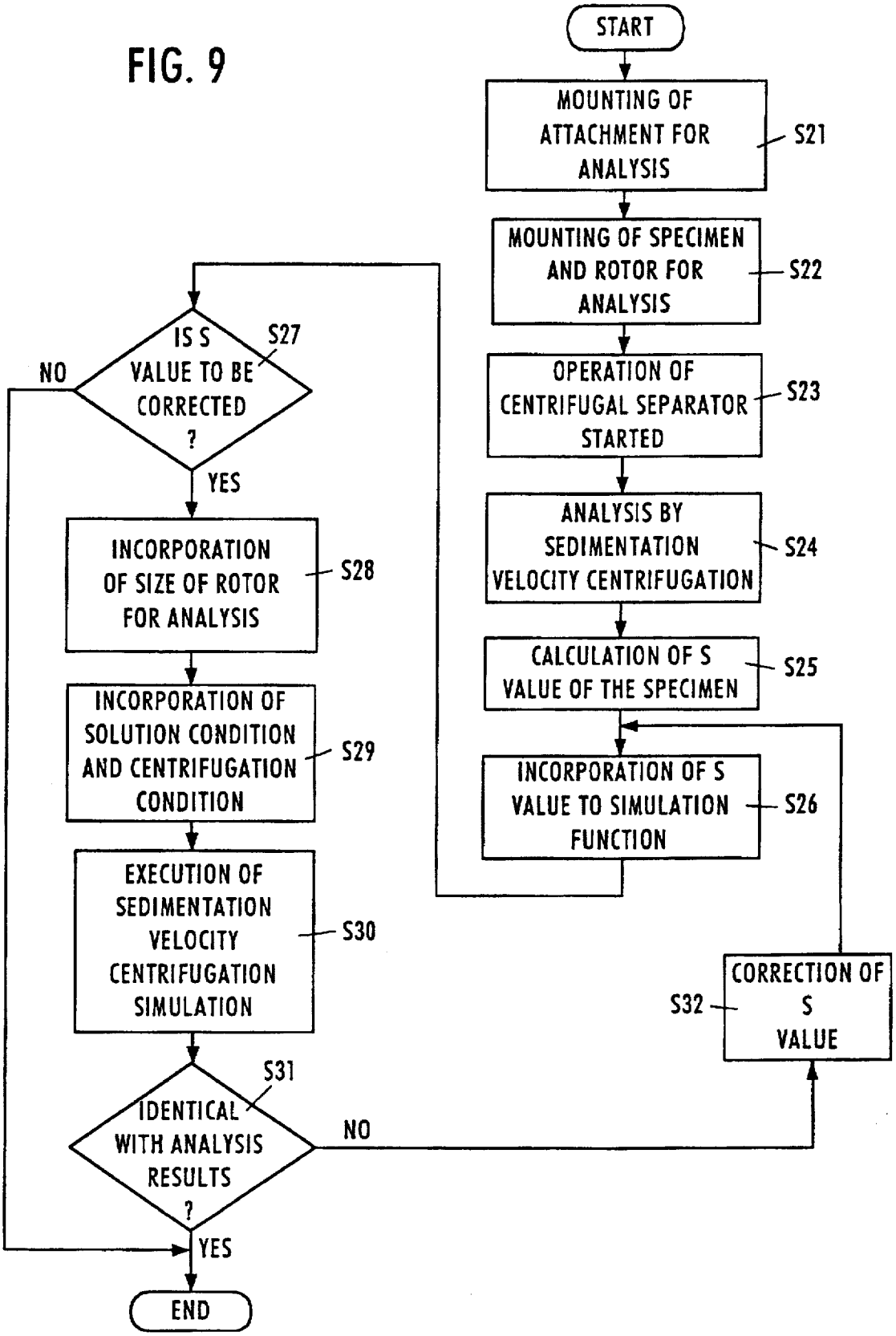
FIG. 9 is a flowchart showing an example of centrifugation simulation method of the present invention.
Figure 10:
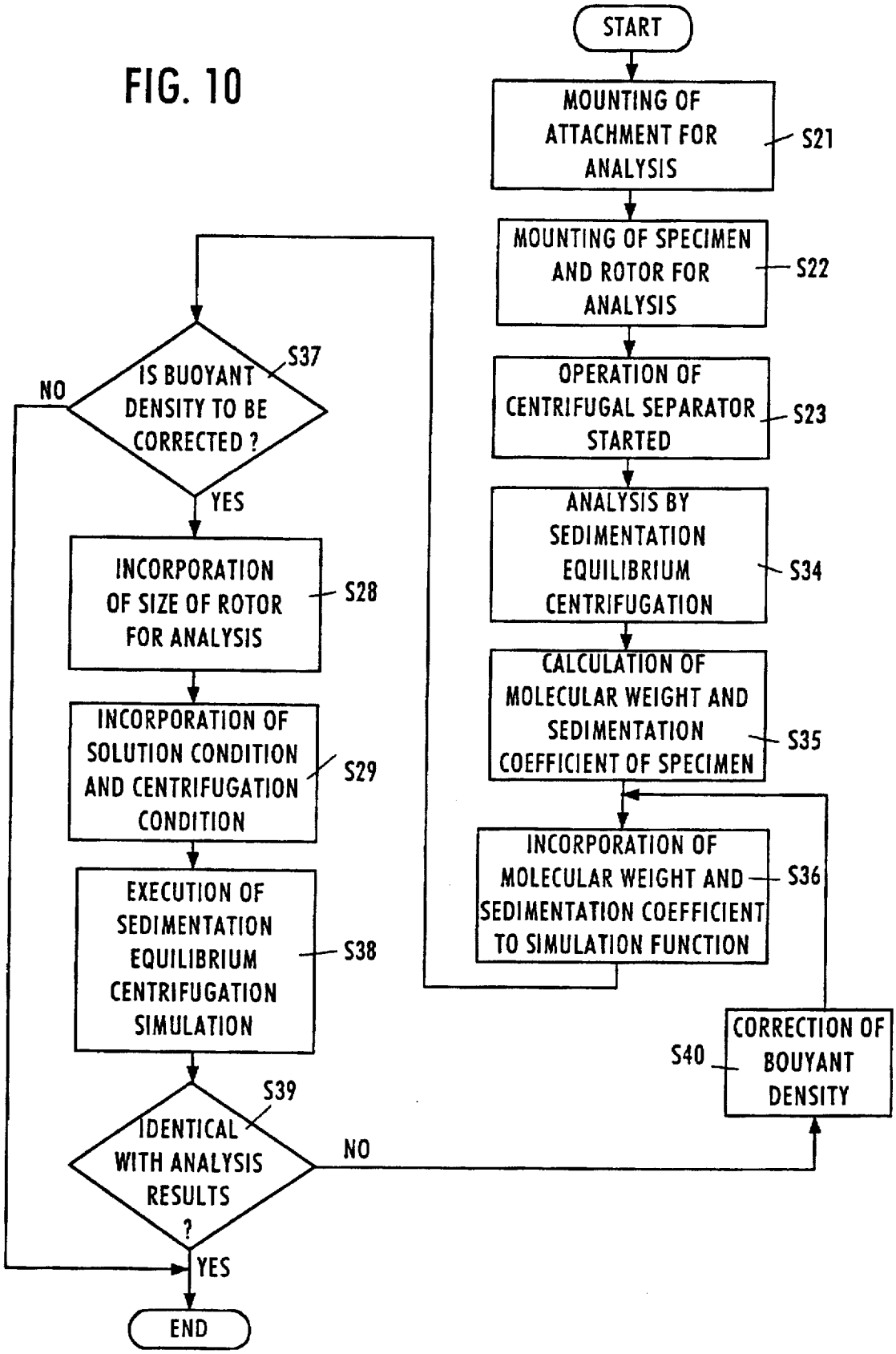
FIG. 10 is a flowchart showing another example of centrifugation simulation method of the present invention.

Flowcharts of FIGS. 9 and 10 show the procedure of the above two examples. FIG. 9 shows the case of sedimentation velocity centrifugation simulation, and FIG. 10 represents the case of sedimentation equilibrium centrifugation simulation. In FIG. 9, the attachment for analysis 15 is mounted on the main unit 1 of centrifugal separator in Step S21. In Step S22, the rotor for analysis 16 is mounted, and a specimen in a rotor cell for analysis 17 is placed in it. Then, in Step S23, operation of the centrifugal separator is started, and analysis by sedimentation velocity centrifugation is performed using the attachment for analysis 15 in Step S24. In the next Step S25, S value of the specimen is calculated, and this S value is incorporated in simulation function in Step S26. In the above steps, Steps S21 to S23 are manually performed by the user. In Step S24, the user can peep at the attachment for analysis 15. If the one with a built-in image incorporation device already known is used, image information can be incorporated into the computer in the simulation unit 20. Based on the data, analysis and the next Steps S25 and S26 are continuously performed.

In the next Step S27, the user can select either one of the case where S value needs correction and the case where it does not. It is inquired in advance whether S value should be corrected or not on screen of the display unit 2, and the user can reply on the manipulation panel 3. By the reply from the user, flag is set, and this flag is read. In case there is no need to correct S value, the program comes to the end immediately.

In case S value is corrected, size of the rotor for analysis 16 is incorporated in the next Step S28, and condition of solution and centrifugation condition are incorporated in Step S29. All of these data are incorporated by reading the data inputted by the manipulation panel. In Step S30, sedimentation velocity centrifugation simulation is executed using these data, and the results are compared with the results of analysis obtained in Step S24, and it is determined whether the results agree with each other or not in Step S31. If the difference between the two results is within several percent, for example, it is determined that the results are identical with each other. If not identical, S value is corrected in Step S32, and it is returned to Step S26.

FIG. 10 shows the case of sedimentation equilibrium centrifugation simulation, and the procedures in Steps S21 to S23, S28, and S29 are the same as in FIG. 9. In Step S34, the results of optical analysis is incorporated into the simulation unit 20 as image data by the attachment for analysis 15 and analysis is performed by sedimentation equilibrium centrifugation, and molecular weight and sedimentation coefficient of the specimen are calculated on the simulation unit 20 in Step S35. In Step S36, these calculation data are incorporated in simulation function.

Step S37 corresponds to Step S27 of FIG. 9, and a preset flag is read by judgment of the user as to whether correction of buoyant density is needed or not as in the case of S value.

In Step S38, sedimentation equilibrium centrifugation simulation is performed, and the result is compared in Step S39 with the result of the analysis of Step S34, and it is determined whether OF not these two results are identical with each other. If not identical, buoyant density is corrected in Step S40, and it is returned to Step S36.

[3] Embodiment of centrifugal separator

Figure 11:
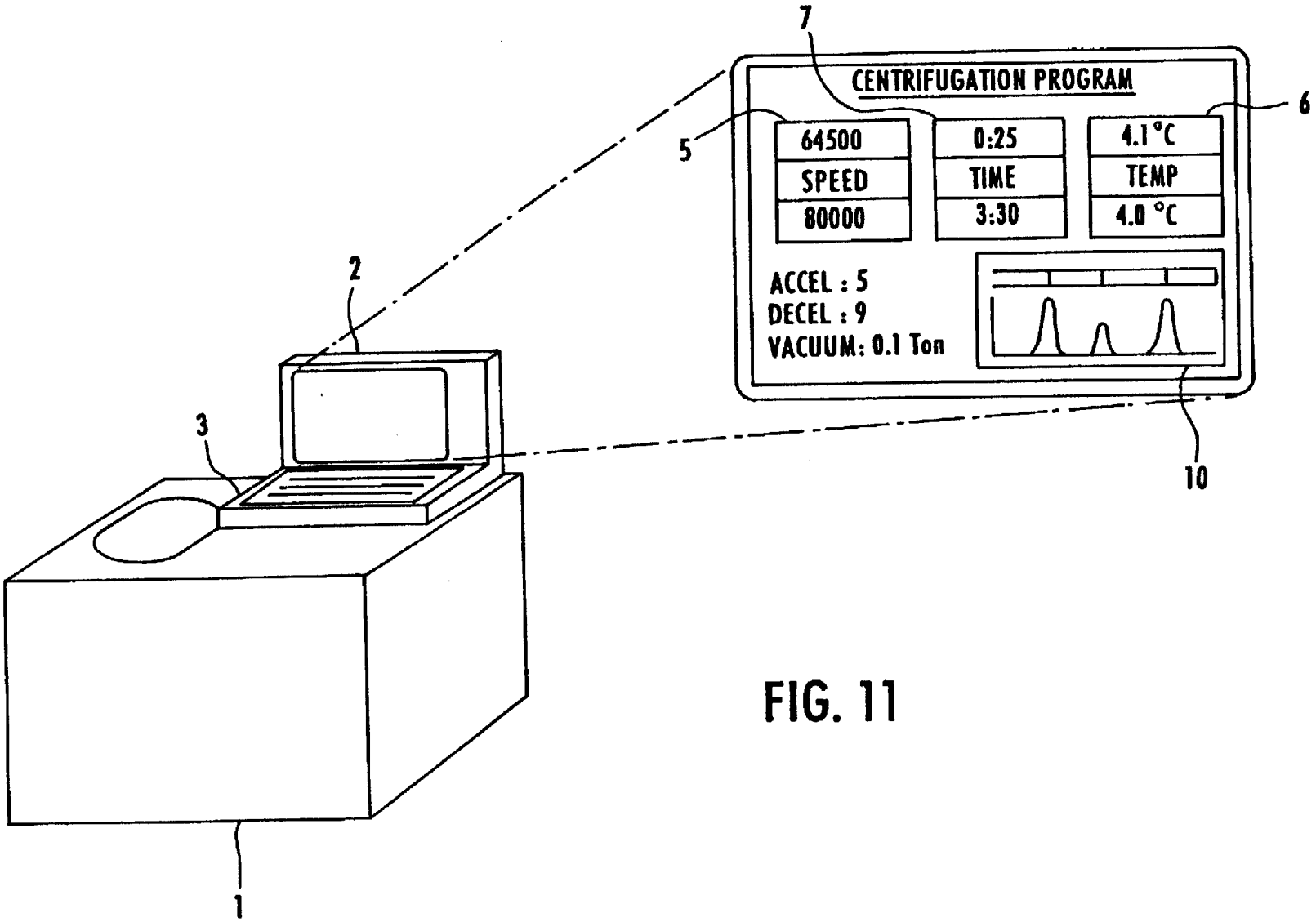
FIG. 11 is a perspective view showing a preferred embodiment of the centrifugal separator of the present invention.

Next, description will be given on an embodiment of centrifugal separator of the present invention, referring to FIGS. 11 and 12. Like the embodiment as described above, the centrifugal separator 1 comprises a display unit 2 and an manipulation panel 3 in order to display centrifugation condition and operation parameters. In general, centrifugation parameters preset by the user and parameters for the current operating condition are displayed on the display unit 2. These parameters include number of centrifugal revolutions 5, temperature 6, operating time 7, etc., and these are displayed on a part of the display unit 2 respectively. In addition to the above parameters, a display area 10 for displaying simulation and result of calculation is provided. In this area 10, intermediate process of centrifugation is displayed which is the feature of the present embodiment.

A microcomputer for performing simulation and control is also provided in the present embodiment as in the above embodiments, and position of specimen separation layer obtained as the result of simulation is given by graphic display on the display area 10 of the display unit 2. Next, description will be given on detailed operation of the present embodiment, referring to FIG. 12, which shows a flowchart for operation of CPU in the microcomputer.

Figure 12:
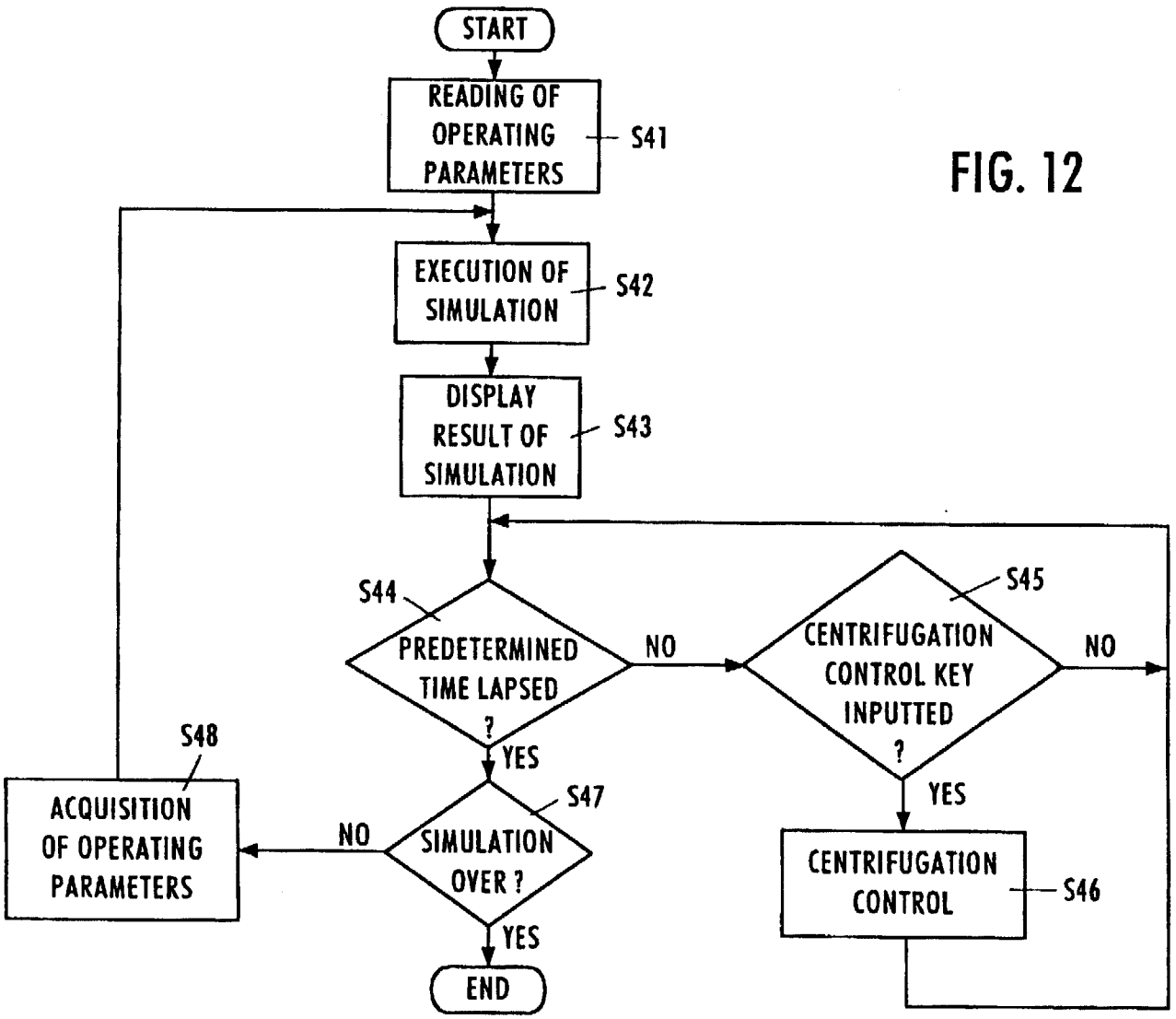
FIG. 12 is a flowchart for explaining operation of CPU in a control unit of the centrifugal separator of the present invention.

The flow in FIG. 12 is started as soon as operation of centrifugal separator is started. In Step S41, operation parameters such as number of revolutions, operating time, type of specimen, etc. inputted in advance through the manipulation panel 3 are read. In Step S42, simulation is performed using operation parameters. The data thus obtained, e.g. data of position of the separation layer, is displayed on the display unit 2 in Step S43. In Step S44, it is determined that the predetermined period of time has elapsed. Before the predetermined time elapses, it is determined whether or not key input has been made for centrifugation control on the manipulation panel 3 in Step S45. If key input is present, the corresponding centrifugation control is carried out in Step S46. If change of number of revolutions, operating time, etc. has been inputted by key, the content is stored in memory, and the corresponding control is carried out. On the other hand, if operation stop has been inputted by key, only the corresponding control is carried out. When Step S46 has been completed, or in case it is determined that there is no key input in Step S45, it is returned to Step S44.

When it is recognized that the predetermined time has elapsed in Step S44, it is determined in Step S47 whether simulation has been completed or not. If not completed, operation parameters currently stored in memory are read in Step S48, and it is returned to Step S42, and simulation is performed again using these parameters. If it is determined that simulation has been completed in Step S46, processing has been completed.

The operation parameters such as operating condition, specimen to be separated, solvent to be used, etc. read in Step S48 may be the same as or different from the operation parameters read in Step S41. There are changes in the parameters in case initialized parameters such as number of revolutions may be artificially changed in the middle of operation, or in case it is programmed in advance to automatically change the parameters in the middle of operation. In both cases, the current operation parameters are stored in the corresponding memory, and these parameters are read and simulation is performed.

In order that the current operation parameters incessantly changing are displayed at real time and operation parameters such as operating condition even when calculation for simulation is under way, changes in the middle of operation are reflected in simulation, it is necessary to execute simulation using the operation parameters after change and to display the results. Such processing can be achieved by advancing to Step S42 via Step S48.

The predetermined time in Step S44 may be the time corresponding to 1/10 of the total operating time or may be fixed time of about 10 minutes. Or, if the time corresponding to 1/10 of the total operating time is longer than 10 minutes, this time may be used as the predetermined time. If it is shorter, the time of 10 minutes may be used as the predetermined time. In case centrifugation is performed using such device, it is generally operated for several hours, and centrifugation is also performed very slowly. Thus, sufficient results can be obtained by simulation at such time interval.

As described above, it is possible according to the apparatus and the method for controlling centrifugal separator of the present invention to obtain the separation results similar to those before the change of conditions even when centrifugation conditions are changed from some unavoidable reasons, and also to save large amount of cost and expense required for preliminary evaluation.

Further, according to the method for centrifugation simulation of the present invention, it is possible to perform centrifugation simulation under condition very close to actual separating operation because the information obtained by the attachment for analysis is added, and it is also possible to evaluate various experimental conditions without carrying out preliminary experiments on trial and error basis by the user to determine the experimental condition. Further, it is possible according to the centrifugal separator of the present invention to identify the current condition of centrifugation via graphic display and numerical display even in the middle of centrifugation operation. For example, it is possible to detect that a certain centrifugation condition has been obtained as the result of centrifugation simulation and to change subsequent separation condition to a more favorable condition at that very moment. Thus, it is possible to eliminate unnecessary steps such as operation of centrifugal separator for unnecessarily long time and to carry out centrifugation in effective manner.

Obviously various minor changes and modifications of the present invention are possible in the light of the above teaching. It is therefore to be understood that within the scope of the appended claims the invention may be practiced otherwise specifically described.

What is claimed is:

1. An apparatus for controlling a centrifugal separator, comprising:

means for inputting centrifugation condition already established as a centrifugation method for a specimen, which is to be centrifuged by a centrifugal separator, as first parameters;

means for inputting centrifugation condition to be used when said specimen is actually centrifuged by said centrifugal separator as second parameters;

means for executing simulation of centrifugal condition using said first parameters and said second parameters respectively;

means for comparing the result of said simulation obtained by the use of said first parameters and said second parameters to determine whether or not these two results have become identical with each other, or to calculate operating time when these two results will be identical with each other; and means for generating a signal for controlling operation of said centrifugal separator in accordance with said means for determining or calculating.

2. An apparatus for controlling a centrifugal separator according to claim 1, wherein said means for generating signal for controlling is designed to generate a signal for stopping operation of said centrifugal separator when the results are determined as being identical with each other.

3. An apparatus for controlling a centrifugal separator having simulation function of centrifugation condition in said centrifugal separator, comprising:

means for incorporating parameters for the current centrifugation operation during centrifugation as a part of parameters of said simulation;

means for executing said simulation function for two times or more by changing time parameters used for simulation of said centrifugation condition at an adequate interval;

means for determining whether or not result for each execution of said simulation function is substantially identical with the result obtained by execution of said simulation function, using centrifugation condition already established as centrifugation method of substantially equal specimen as parameters;

means for calculating operating time to obtain said identical separation results; and means for generating a signal for controlling operation of said centrifugal separator based on said means for determining.

4. A method for controlling a centrifugal separator, comprising the steps of;

inputting centrifugation condition already established as centrifugation method of said specimen, when centrifuging a specimen by a centrifugal separator, before starting centrifugation or during centrifugation as first parameters;

executing simulation of centrifugation condition using said first parameters, inputting centrifugation condition to be used when said specimen is centrifuged by said centrifugal separator as second parameters;

executing simulation of centrifugal separation using said second parameters;

comparing the results of said simulation obtained by the use of said first parameters and said second parameters to determine whether or not these two results have become identical with each other or to calculate operating time when these two results will be identical with each other; and generating a signal for controlling operation of said centrifugal separator in accordance with the determining step or calculating step.

5. A method for simulating centrifugation, comprising the steps of:

mounting an attachment for analysis and a rotor for analysis on a centrifugal separator, on which the attachment for analysis can be mounted, and placing a specimen on said rotor for analysis;

starting operation of said centrifugal separator;

simulating centrifugation according to predetermined centrifugation condition and other information;

optically analyzing said specimen using said attachment for analysis; and correcting parameters to be used for said simulation by the use of data obtained as the result of said analysis.

6. A method for simulating centrifugation according to claim 5, wherein said step for correcting said parameters is to correct said parameters in such a manner that the result of said optical analysis is identical with the result obtained by execution of said simulation.

* * * * *